US005735158A

United States Patent [19]

Brunson

[11] Patent Number: 5,735,158

[45] Date of Patent: Apr. 7, 1998

[54] METHOD AND APPARATUS FOR SKEW CORRUGATING FOIL

[75] Inventor: Gordon Wayne Brunson, Chagrin Falls, Ohio

[73] Assignee: Engelhard Corporation, Iselin, N.J.

[21] Appl. No.: 728,642

[22] Filed: Oct. 10, 1996

[51] Int. Cl.[6] ..... B21D 13/04

[52] U.S. Cl. ..... 72/196

[58] Field of Search ..... 72/190, 196; 425/336

[56] References Cited

U.S. PATENT DOCUMENTS

| | | | |
|---|---|---|---|
| 520,366 | 5/1894 | Leaver . | |
| 1,536,897 | 5/1925 | Loafea | 72/196 |
| 1,868,302 | 7/1932 | Auger . | |
| 1,910,020 | 5/1933 | Boutillier et al. . | |
| 2,023,965 | 12/1935 | Lysholm . | |
| 2,940,736 | 6/1960 | Odman . | |
| 3,037,592 | 6/1962 | Shipley et al. . | |
| 3,088,271 | 5/1963 | Smith . | |
| 3,183,963 | 5/1965 | Mondt . | |
| 3,205,109 | 9/1965 | Schudel . | |
| 3,257,260 | 6/1966 | Morgan . | |
| 3,430,476 | 3/1969 | Duda . | |
| 3,447,352 | 6/1969 | Miller . | |
| 3,470,053 | 9/1969 | Rule . | |
| 3,513,054 | 5/1970 | Carrel . | |
| 3,679,537 | 7/1972 | Huer et al. . | |
| 3,910,344 | 10/1975 | Hagen . | |
| 3,916,054 | 10/1975 | Long et al. . | |
| 3,953,176 | 4/1976 | Santala et al. . | |
| 3,982,981 | 9/1976 | Takao et al. . | |
| 3,992,330 | 11/1976 | Noakes et al. . | |
| 4,072,007 | 2/1978 | Sanday . | |
| 4,157,929 | 6/1979 | Kubicek . | |
| 4,200,441 | 4/1980 | Honmann et al. . | |
| 4,273,681 | 6/1981 | Nonnenmann . | |
| 4,318,888 | 3/1982 | Chapman et al. . | |
| 4,345,640 | 8/1982 | Cullinan . | |
| 4,382,323 | 5/1983 | Chapman et al. . | |
| 4,449,573 | 5/1984 | Pettersson et al. . | |
| 4,673,553 | 6/1987 | Retallick . | |
| 4,711,009 | 12/1987 | Cornelison et al. . | |
| 4,725,411 | 2/1988 | Cornelison . | |
| 4,748,838 | 6/1988 | Cornelison . | |
| 4,753,919 | 6/1988 | Whittenberger . | |
| 4,765,047 | 8/1988 | Retallick . | |
| 4,823,583 | 4/1989 | Bullock et al. . | |
| 4,832,998 | 5/1989 | Cyron . | |
| 4,838,067 | 6/1989 | Cornelison . | |
| 4,847,966 | 7/1989 | Kuchelmeister . | |
| 4,863,895 | 9/1989 | Behr . | |
| 4,923,109 | 5/1990 | Cyron . | |
| 4,928,485 | 5/1990 | Whittenberger . | |
| 4,930,569 | 6/1990 | Harder . | |
| 4,953,629 | 9/1990 | Karlsson et al. . | |
| 4,968,833 | 11/1990 | Driscoll et al. . | |
| 5,025,649 | 6/1991 | Retallick . | |
| 5,051,294 | 9/1991 | Lunkas et al. . | |
| 5,162,288 | 11/1992 | Stringaro . | |
| 5,170,624 | 12/1992 | Cornelison et al. . | |
| 5,202,303 | 4/1993 | Retallick et al. . | |
| 5,240,682 | 8/1993 | Cornelison et al. . | |
| 5,310,586 | 5/1994 | Mullen . | |
| 5,318,102 | 6/1994 | Spokoyny et al. . | |
| 5,346,389 | 9/1994 | Retallick et al. . | |
| 5,406,704 | 4/1995 | Retallick . | |
| 5,437,099 | 8/1995 | Retallick et al. . | |
| 5,512,250 | 4/1996 | Betta et al. . | |

*Primary Examiner*—Lowell A. Larson

[57] ABSTRACT

A method and apparatus for continuously forming corrugated sheet material in which corrugations are oriented at an oblique angle to side edges of the sheet material. The apparatus includes a pair of corrugating gear rollers supported for rotation on respective first and second parallel axes, the corrugating gear rollers having meshing linear teeth parallel to the first and second axes and providing a corrugating nip. At least one of the first and second gear rollers are movable toward and away from the other of said gear rollers to position the teeth in respective conditions of corrugating and released meshing engagement at the corrugating nip. The sheet material is directed to the corrugating nip along a path at an oblique angle to the axes of the corrugating gear rollers and the corrugating gear rollers are driven to corrugate the sheet material while the teeth are alternated between conditions of corrugating and released meshing engagement at the corrugating nip.

12 Claims, 6 Drawing Sheets

METHOD AND APPARATUS FOR SKEW CORRUGATING FOIL

BACKGROUND OF THE INVENTION

1. Field of the Invention

This invention relates to a method and apparatus for skew corrugating foil, and, more particularly to such a method and apparatus for skew corrugating metal foil for catalytic converter carrier bodies.

2. Description of the Related Art

The use of skew corrugated metallic foil as a honeycomb carrier for catalytic converters has exhibited performance advantages over the more traditional herringbone and straight-celled forms. Skew corrugated foil is formed with straight corrugations which are oriented at an oblique angle to the longitudinal axis of a foil strip. For several years, there has been an interest in a corrugated product of this form because of the facility it offers for providing a honeycomb carrier body of non-nesting corrugated sheets having straight passageways. However, an adequate tooling design has not been developed for effective commercial production.

Feeding a flat foil strip angularly into a straight-toothed gearset has not been feasible due to a severe tracking problem, that is, the foil "climbs" along the tooling axis as corrugation proceeds. Likewise, feeding foil perpendicularly into a wide helical gearset is also unfeasible due to a similar tracking problem.

An apparatus for skew corrugating has been built and tested in which the tracking problem was thought to have been eliminated. A herringbone gear set was produced with two very wide helical gears. This design was based on the assumption that each helical gear would draw the foil web away from the center of the toolset with an equal force, thus achieving a balance. The resulting foil was to have one wide herringbone pattern. Slitting the foil down the center would yield two skew corrugated foils. But the equilibrium position of the foil web during corrugation proved to be very unstable, making foil tracking difficult if not impossible.

Another innovative approach to the formation of skew corrugated foil involved a complex method of coining traditional straight-celled foil. This technique used a series of angled folds which allowed the straight-celled foil to stack up in a non-nesting way. The resulting stack had cells similar to skew corrugated cells, but the complex folding schemes could not produce a stack with line generated outside profiles and therefore complex coining and packaging was required.

Several more recent concepts were developed for the skew corrugating process. These concepts grew out of an effort to prepare skewed samples and involved feeding a foil strip at an oblique angle into a set of straight toothed corrugation gears. The foil was allowed to track up the axis of the tooling until it approached one end. At this point, the corrugator was stopped and adjusted to loosen the gears slightly. The loose foil was then slid across the tooling, the corrugator was readjusted to tighten the gears back into corrugating position, and the cycle was repeated. In this way, samples were prepared but at a rate that was too slow for commercial production.

A fundamental part of the sample preparation technique was the combination of longitudinal and lateral foil motion. The longitudinal motion of the foil corresponded to the tangential vector of the gearset and occurred during corrugation. The lateral motion corresponded to the axial vector of the gearset and occurred as the foil was slid down the loosened gearset. A similar result could be achieved if the gear teeth slid axially with respect to the tooling during corrugation. The foil would then follow the motion of the teeth, and each tooth could be repositioned for another stroke during that part of the gear revolution when the tooth was out of contact with the foil. Variations of tooling based on the idea of sliding gear teeth were developed.

These tooling variations all relied on a cylinder with axial slots in which sliding corrugating teeth were received. Different schemes of actuation were used. One involved a series of hydraulic pistons which pushed the teeth, and depended on a hydraulic "commutator" and many small axial pistons installed in the tooling. Both aspects of the tooling made it complex and prone to failure.

Another concept utilized a swashplate which pushed the teeth axially. Needle bearings were used to support the swashplate, and provision was made for adjustment of the swashplate angle. Friction pads installed on the ends of the teeth contacted the swashplate. Since the angle of contact between swashplate and teeth changed throughout the rotation cycle of the tooling, the sliding contact area between friction pads and swashplate was small. For this reason, the durability of the friction pads was a problem.

A second swashplate concept acted to pull the teeth via cables. Since the cables provided a flexible link between swashplate & teeth, there was no sliding contact to threaten durability. But this concept became very complex, with many small parts and assemblies.

From the foregoing, it will be appreciated that tooling apparatus and methods for forming skew corrugated metallic foil have received considerable attention, but remain complex in design or have shortcomings in practice, and are in need of improvement.

SUMMARY OF THE INVENTION

The advantages and purpose of the invention will be set forth in part in the description which follows, and in part will be obvious from the description, or may be learned by practice of the invention. The advantages and purpose of the invention will be realized and attained by means of the elements and combinations particularly pointed out in the appended claims.

To attain the advantages and in accordance with the purpose of the invention, as embodied and broadly described herein, the invention resides in an apparatus for continuously forming corrugated sheet material in which corrugations are oriented at an oblique angle to side edges of the sheet material. The apparatus includes a pair of corrugating gear rollers supported for rotation on respective first and second parallel axes, the corrugating gear rollers having meshing linear teeth parallel to the first and second axes and providing a corrugating nip. At least one of the first and second gear rollers are movable toward and away from the other of said gear rollers to position the teeth in respective conditions of corrugating and released meshing engagement at the corrugating nip. The sheet material is directed to the corrugating nip along a path at an oblique angle to the axes of the corrugating gear rollers and the corrugating gear rollers are driven to corrugate the sheet material while the teeth are alternated between conditions of corrugating and released meshing engagement at the corrugating nip.

In another aspect, the invention is directed to a method for forming corrugations in sheet material so that the corrugations are oriented at an oblique angle to side edges of the sheet material. The method entails feeding the sheet material along a path at an oblique angle to a corrugating nip between a pair of corrugating gear rollers rotatable on parallel axes, the corrugating gear rollers having linear teeth parallel to the axes and in mesh at a corrugating nip. The teeth are alternated between conditions of corrugating and released meshing engagement at the corrugating nip, while the sheet material is fed along the path. Corrugations are formed in the sheet with the teeth in corrugating meshing engagement, and the sheet material is returned laterally to the path upon movement of the teeth to the condition of released meshing engagement after displacement of the sheet from the path in a direction parallel to the corrugating roller axes during formation of corrugations.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate an embodiment of the invention and together with the description, serve to explain the principles of the invention. In the drawings.

DESCRIPTION OF THE PREFERRED EMBODIMENT

Reference will now be made in detail to the present preferred embodiment of the invention, an example of which is illustrated in the accompanying drawings. Wherever possible, the same reference numbers will be used throughout the drawings to refer to the same or like parts.

The apparatus of the invention, for continuously forming corrugated sheet material in which corrugations are oriented at an oblique angle to side edges of the sheet material, includes a pair of corrugating gear rollers supported for rotation on respective first and second parallel axes, the corrugating gear rollers having meshing linear teeth parallel to the first and second axes and providing a corrugating nip.

Figure 1:
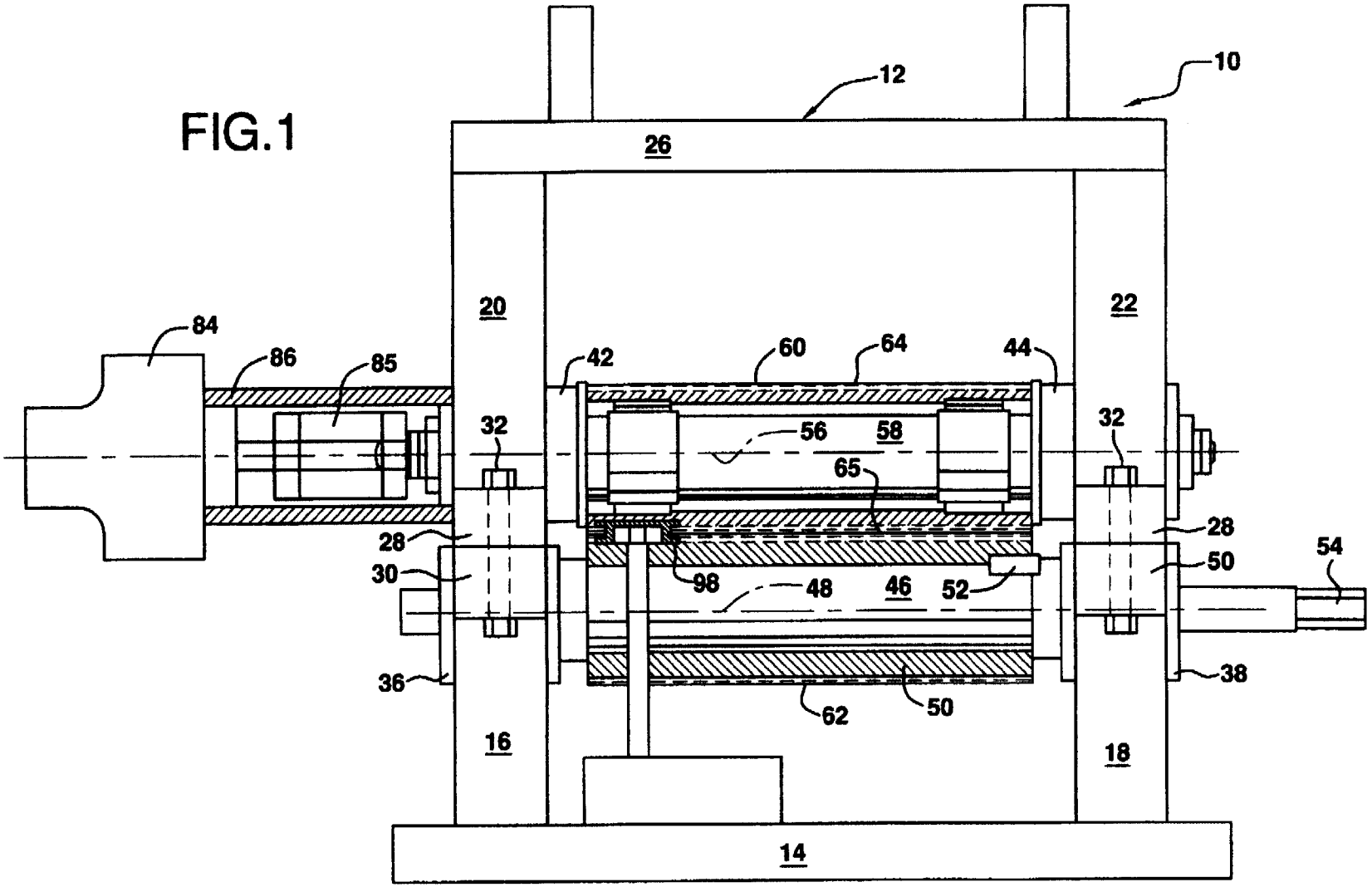
FIG. 1 is a front elevation in partial cross-section illustrating an embodiment of a corrugating machine incorporating the present invention.
Figure 2:
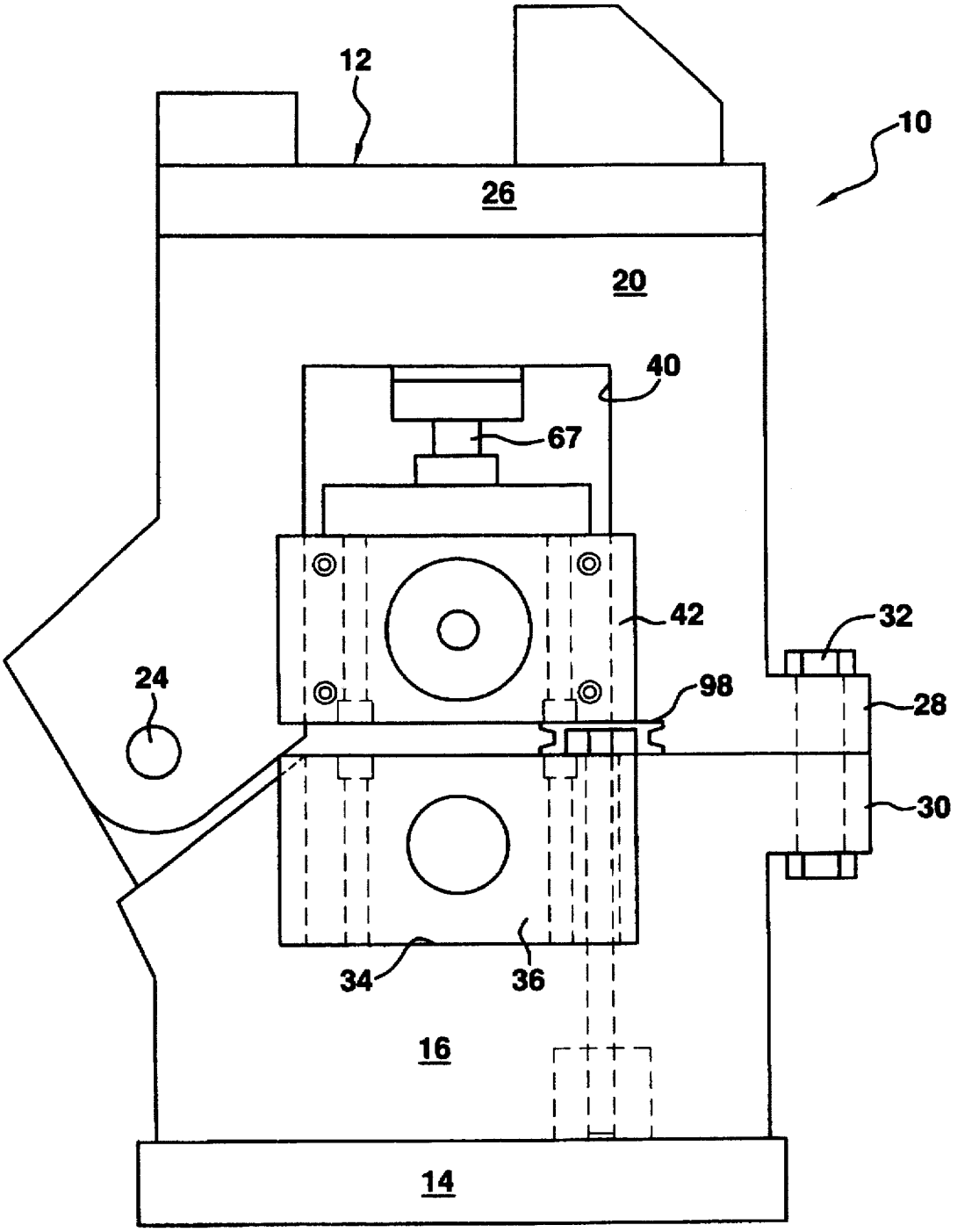
FIG. 2 is a side elevation of the machine illustrated in FIG. 1.

A presently preferred embodiment of the apparatus of the invention is represented in FIGS. 1 and 2 of the drawings by a corrugating machine generally designated by the reference numeral 10. As shown, the machine 10 has a frame 12 including a base plate 14, a pair of bottom end plates 16 and 18 welded or otherwise secured to the base 14, a pair of top end plates 20 and 22 hinged by a pin 24 to the top and rear of the bottom end plates 16 and 18, and a top plate 26 welded or otherwise appropriately secured to the tops of the top end plates 20 and 22. The front edges of the bottom and top end plates 20 and 22 are formed with projecting bosses 28 and 30 to receive removable bolts 32, which in cooperation with the pin 24, secure the top end plates 20 and 22 and the bottom end plates 16 and 18 firmly against each other.

The bottom end plates 16 and 18 are formed with upwardly opening windows 34 (FIG. 2) for receiving a pair of bottom bearing blocks 36 and 38. The upper end plates 20 and 22 are similarly provided with rectangular windows 40 and receive top bearing blocks 42 and 44.

The bottom bearing blocks 36 and 38 support a shaft 46 for rotation about a bottom fixed axis 48 in the illustrated embodiment. A lower corrugating gear roller 50 is fixed to rotate on the axis 48 with the shaft 46 by appropriate means such as a key 52. The end of the shaft 46 supported by the bearing block 38 projects outwardly to a splined end 54 for connection to and to be driven by a power source such an electric or air motor (not shown). The top bearing blocks 42 and 44 define an axis 56 of support for a shaft assembly 58, on which an upper gear roller 60 is carried in a manner to be described in more detail below. Both gear rollers 50 and 60 are formed with external linear gear teeth 62 and 64, respectively, capable of meshing engagement at a corrugating nip 65 parallel to both axes 48 and 56. As shown in FIG. 2, the bottom bearing blocks 36 and 38 abut against the bottom edges of the windows 34 to fix the position of the axis 48 of the lower gear roller 50. However, the top bearing blocks 42 and 44 adjustable vertically in the windows 40 by adjustment devices 67 to enable precise preset spacing of the gear teeth 62 and 64 at the corrugating nip 65 for accommodation of different thicknesses of foil sheet material to be corrugated, as well as for different corrugation heights and pitches.

In accordance with the invention, at least one of the two gear rollers is movable toward and away from the other of the two gear rollers to position the teeth of the two gear rollers in respective conditions of corrugating and released meshing engagement at the corrugating nip.

Figure 3:
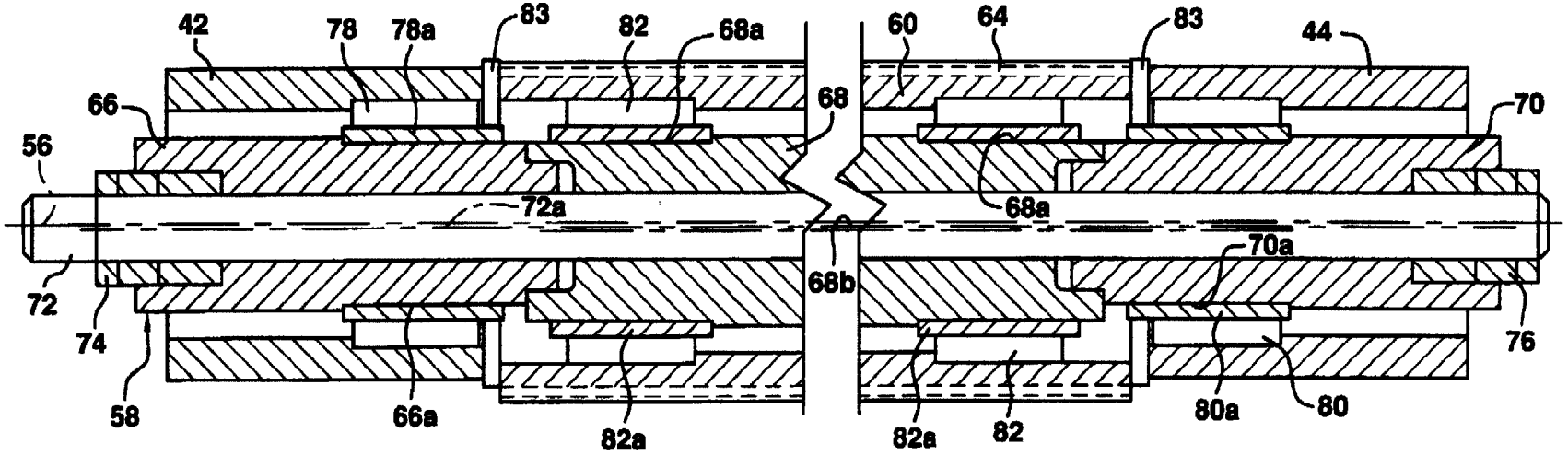
FIG. 3 is an enlarged fragmentary cross-section of a shaft assembly in the machine illustrated in FIG. 1.

In the illustrated embodiment, and as shown most clearly in FIG. 3 of the drawings, the shaft assembly 58 carrying the upper gear roller 60 includes three eccentric shaft components 66, 68 and 70 adjustably secured end-to-end against rotation relative to each other by an axial rod 72 having an axis **72*a* and end clamp fittings 74 and 76. As shown, shaft components 66 and 70 at the ends of the shaft assembly 58 engage opposite ends of the central shaft component 68. All internal surfaces of the three eccentric shaft components are concentric with the axis 72*a* of the axial rod 72. Exterior bearing surfaces on the shaft components 66, 68 and 70, however, are eccentric with respect to the axis 72*a*. In particular, the end shaft components 66 and 70 have external bearing surfaces 66*a* and 70*a* centered on the axis 56 of support by the bearing blocks 42 and 44. Thus, the central axis 72*a* of the rod 72 is eccentric with respect to the axis 56. The central shaft component 68 has a pair of external surfaces 68*a* centered on a bearing axis 68*b*. Thus, by relative rotational adjustment of both end shaft components 66 and 70 relative to the central shaft component 68, the amount of eccentricity of the bearing axis 68*b* of the central shaft component 68 may be adjusted relative to the support axis 56**.

The shaft assembly 58 is supported rotatably from the bearing blocks 42 and 44 by roller bearings 78 and 80 having respective inner races **78*a* and 80*a* fitted on the eccentric bearing surfaces 66*a* and 70*a* of the end shaft components 66 and 70. Thus, rotation of the shaft assembly 58 in the bearing blocks on the axis 56 of support results in orbital movement of the axial rod 72 about the axis 56. When the central shaft component 68 is oriented so that the eccentricity of the bearing surfaces 68***a* is added to that of the end shaft component bearing surfaces 66*a* and 70*a*, as shown in FIG. 3, upon rotation of the shaft assembly 58, the bearing surfaces 68*a* of the central shaft component 68 will also orbit in a path about the axis 56. Depending on the relative angular orientation of the central shaft component 68 and the end shaft components 66 and 70, the bearing surfaces 68*a* of the central shaft component 68 will orbit in a circular path with a radius less than, equal to, or greater than the radius of orbital movement of the axial rod 72 about the axis 56.

The upper gear roller 60 is journaled on the central eccentric shaft component 68 by roller bearings 82 having inner races 82*a* fitted on the bearing surfaces 68*a*. Also, low friction washers 83 are positioned between the ends of the gear roller 60 and the bearing blocks 42 and 44. Therefore, in the illustrated embodiment, rotation of the gear roller 60 is fully independent of rotation of the shaft assembly 58.

With reference again to FIG. 1, it will be noted that the shaft assembly 58 is arranged to be driven in rotation by an air motor 84 mounted to the bearing block 42 by a bracket 86. A flexible drive coupling 85 connects rotary output of the motor 84 to the shaft assembly 58. This driving arrangement for the shaft assembly 58 is independent of the drive (not shown) coupled to the splined end 54 of the shaft 46 on which the lower gear roller 50 is mounted.

Figure 5:
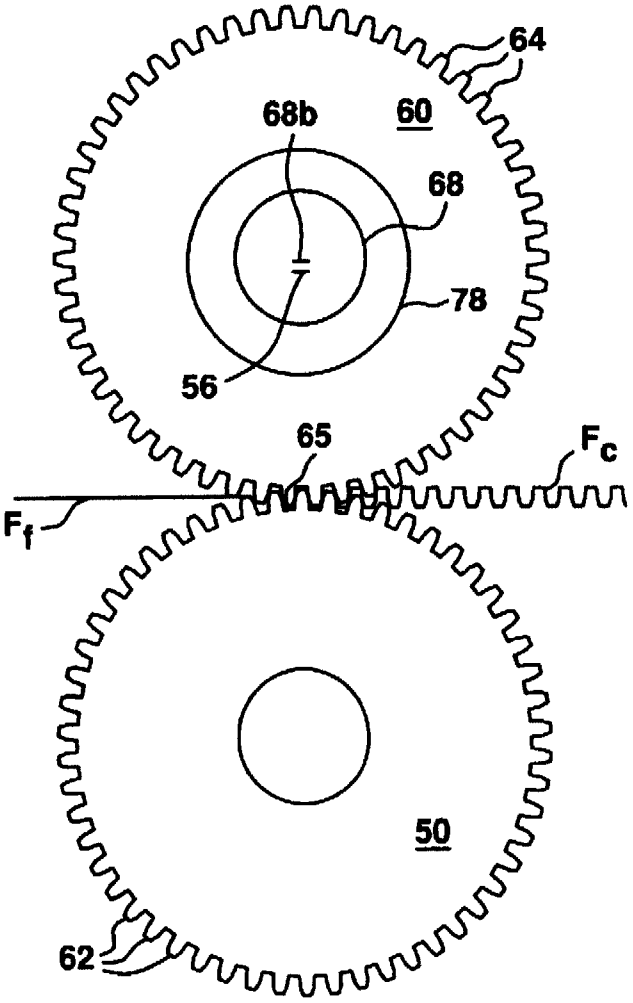
FIG. 5 is an end view similar to FIG. 4 but illustrating the components in a different condition of operation.
Figure 4:
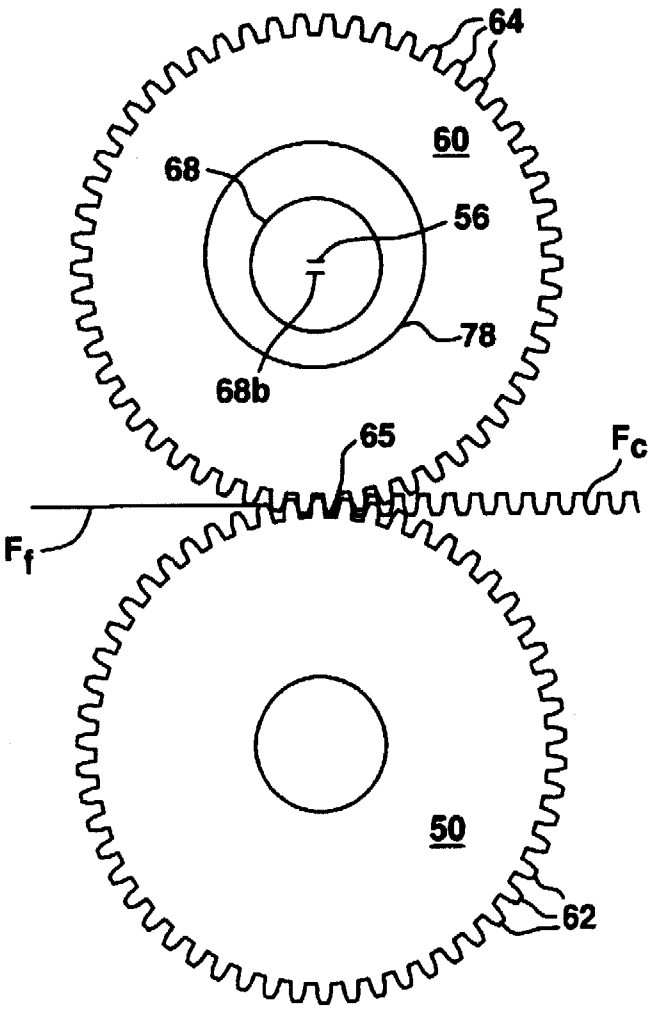
FIG. 4 is a schematic end elevation showing operation of the machine in one condition of operation.

In FIGS. 4 and 5 of the drawings, movement of the upper gear roller 60 relative to the lower gear roller 50 is depicted schematically during operation of the machine 10 to corrugate a flat foil strip $F_f$. In these figures, the roller bearings 78 in the top bearing blocks 42, 44 are represented by the illustrated relatively large circle concentric with the axis 56 of support by the bearing blocks. The central shaft component 68 of the shaft assembly 58 is represented by the relatively small circle which is concentric with the axis 68*b* and with the pitch circle of the gear teeth 64, as described above.

In FIG. 4, the upper gear roller 60 is in corrugating meshing engagement with the lower gear 50. This condition of meshing engagement effects a conversion of the flat foil stip $F_f$ to a corrugated foil strip $F_c$ essentially as shown in both FIGS. 4 and 5. Also, it will be noted that in this condition of corrugating mesh, the axis 68*b* of the shaft assembly component 68, and thus the axis of the upper gear roller 60, is positioned under the axis 56 of support by the bearing blocks 42 and 44. Also, the foil stip $F_f$ is advanced by driving rotation of the lower gear roller 50. The upper gear roller 60, as described above, is journaled freely on the shaft assembly 58 and acts as an idler gear rotated only because of meshing engagement of the teeth 64 with the teeth 62 on the driven lower gear roller 50, through the foil $F_c$ in which corrugations are formed.

In FIG. 5, the shaft assembly 58 is rotated 180° from that shown in FIG. 4. Thus, in FIG. 5, the axis 68*b* of the shaft assembly component 68 and thus of the gear roller 60, is above the axis 56 of support by the bearing blocks 42, 44. In the condition illustrated in FIG. 5, the teeth 64 of the upper gear roller 60 remain in mesh with the lower gear roller 52 through the foil web $F_c$, but in a condition of released meshing engagement at the corrugating nip 65. As a result, the upper gear 60 will continue to rotate and be driven by the lower gear roller 52 but the foil web $F_f$,$F_c$ is released sufficiently to permit axial movement along the gear roller teeth 62 and 64 at the corrugating nip 65. The consequence of this releasing operation will be described in more detail below.

In accordance with the present invention, a continuous strip of sheet material is fed in a path at an oblique angle to the corrugating nip between the corrugating gear rollers while the teeth on the gear rollers are alternated between conditions of corrugating and released meshing engagement. Displacement of the strip laterally from the feed path during corrugating meshing engagement of the gear roller teeth is accompanied by a return of the strip to the feed path during released meshing engagement of the gear roller teeth.

Figure 6:
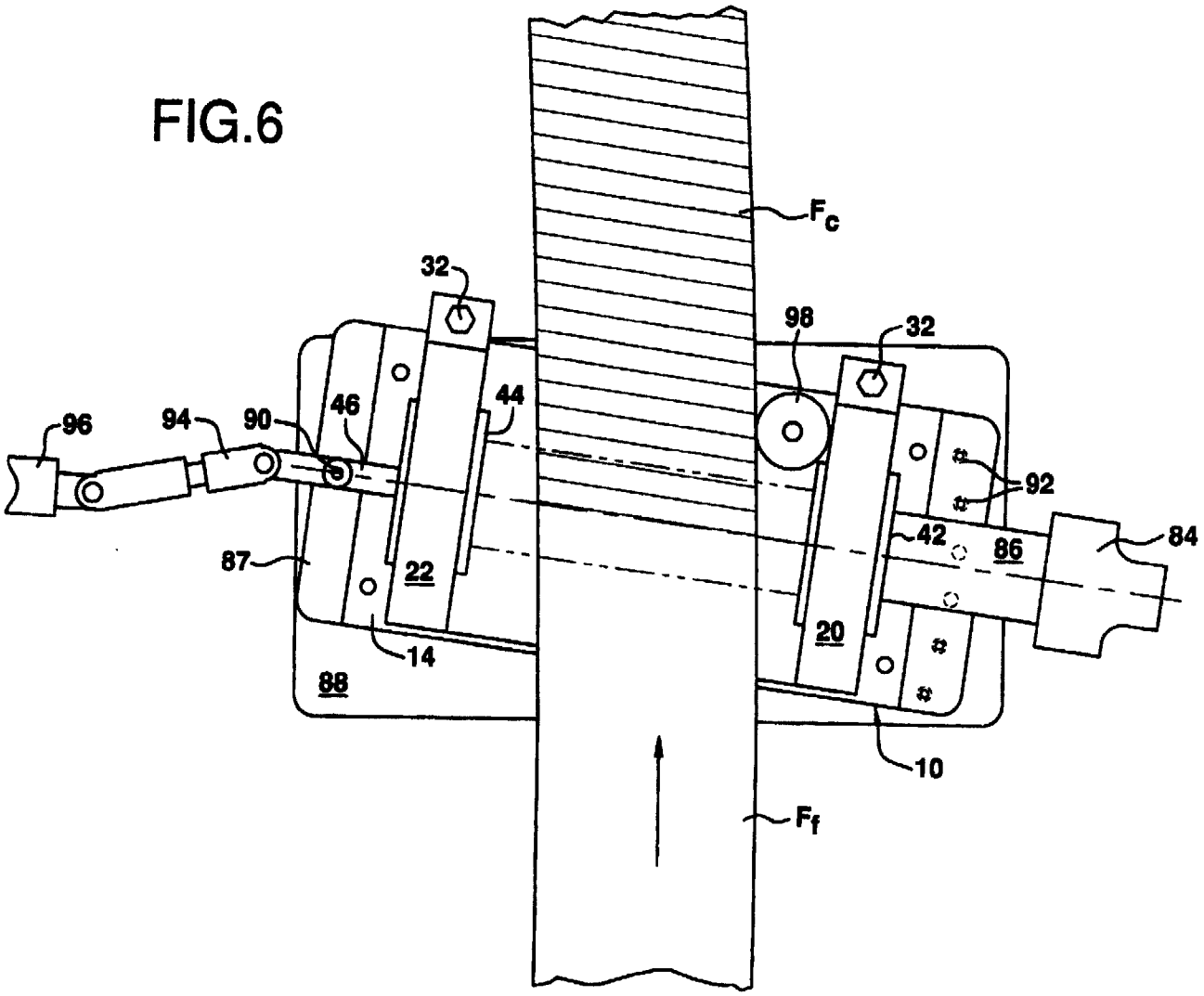
FIG. 6 is a top plan view of the machine shown in FIG. 1.

In FIG. 6, the machine 10 is shown mounted on a supporting plate 87, in turn mounted on a fixed plate 88 for pivotal adjustment on a vertical axis 90 at one end and capable of being fixed at one of several angular positions by connection of the end of the plate 87 opposite the axis 90, to the fixed plate 88 through holes 92 arranged in an arc centered on the axis 90. The shaft 46 of the lower gear roller 50 is connected through a universal-type coupling 94 to a drive shaft 96 adapted to be driven by a suitable power source such as an electric motor or air motor (not shown). Thus, it will be appreciated that for a fixed orientation of the plate 88, the support axes 48 and 56 of the gear rollers 50 and 60 may be adjusted angularly relative to the plate 88 and to the drive 96 through a variety of oblique angles.

In operation, a continuous strip of flat metal foil $F_f$ is fed to the corrugating nip 65 (FIGS. 4 and 5) from a coil or other source of supply (not shown) along a path normal to the fixed plate 88 but at an oblique angle with respect to the axes 48 and 56, which are parallel to the corrugating nip 65.

As the flat foil strip $F_f$ is drawn through the corrugating nip 65 by driving the lower roller 50 with the power input 96, the upper gear roller 60 is alternated between conditions of corrugating and released meshing engagement with the lower gear roller 50 as a result of the air motor 84 driving the shaft assembly 58 so that the axis 68*b* of the upper gear roller 60 travels in an orbital path about the axis of support 56, as described above with reference to FIGS. 4 and 5.

Although the angular relationships of the operation will be described in more detail below, it will be noted from FIG. 6 that upon conversion of the flat strip $F_f$ to the corrugated stip $F_c$, the corrugated foil stip $F_c$ is delivered from the corrugating nip 65 at a small angle to the direction of the feed path represented by the arrow $F_p$ in FIG. 6. As illustrated in FIG. 6, the direction of delivery of the corrugated foil $F_c$ shifts slightly to the left of the direction $F_p$. On the other hand, during the formation of a corrugation in the foil strip, the strip is displaced in the opposite direction or to the right, as viewed in FIG. 6, by the gear rollers 50 and 60 during corrugating meshing engagement of the teeth 62 and 64.

A guide, such as a guide roller 98, positioned downstream from the corrugating nip on the right-hand side of the corrugated foil strip $F_c$, functions to return the foil strip to its original path each time the gear rollers are positioned in a condition of released meshing engagement as shown in FIG. 5. Because the corrugated strip $F_c$ is laterally resilient, and because lateral displacement of the foil strip during each interval that the teeth 62 and 64 are in corrugating meshing engagement is relatively small, the guide roller 98 may be fixed relative to the base plate 14, as shown is FIGS. 1 and 2.

In practice, the air motor 84 drives the shaft assembly 58 on which the upper gear roller 60 is supported at speeds so that the upper gear roller is alternated between corrugating meshing engagement and released meshing engagement at least once for each corrugation formed and preferably at least twice for each such corrugation.

Figure 7:
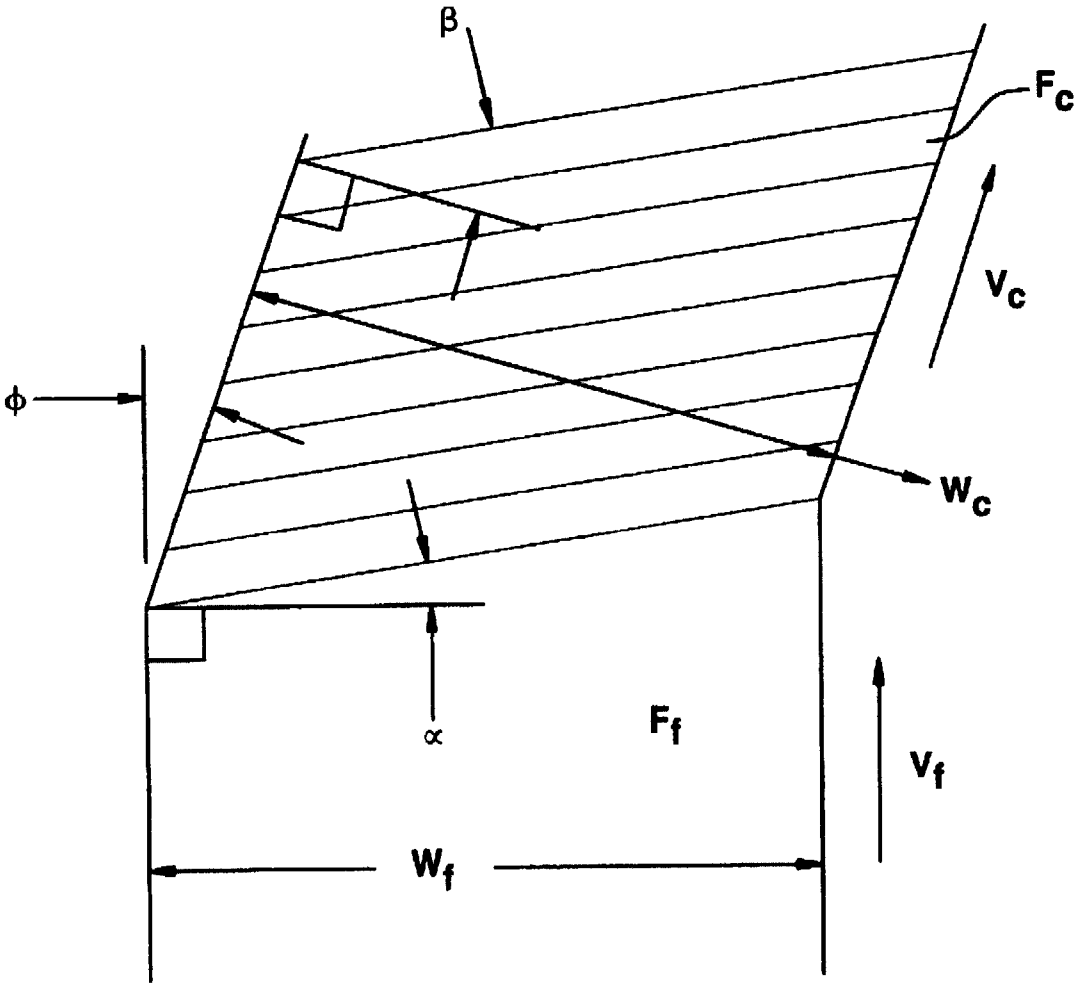
FIG. 7 is a schematic plan view illustrating angular dimensional and velocity parameters of a foil strip during corrugation by the machine shown in FIG. 1.

In FIG. 7, angular geometry, as well as dimensional and velocity parameters of the foil strip $F_f$, $F_c$ are depicted in an exaggerated schematic plan view. As shown, $\alpha$ designates the angle between the tooling axis (i.e., the axes 48 and 56 of the gear rollers 50 and 60) and a line perpendicular to the side edges of the flat foil strip $F_f$; $\beta$ designates the angle between formed corrugations in the corrugated strip $F_c$ and the side edges of the corrugated strip $F_c$; and $\Phi$ designates the angle between the side edges of the flat foil strip $F_f$ and the side edges of the corrugated foil strip $F_c$. These angles are related by the equation:

$$\alpha=\beta-\Phi \tag{1}$$

Further, the angles $\beta$ and $\Phi$ are related by the equation:

$$\Phi = \mathrm{Tan}^{-1}\left[\frac{e}{(\tan\beta)}\right]-\frac{\Pi}{2}+\beta \tag{2}$$

where e is the extension factor for corrugated foil, that is, the ratio of the length of a flat foil strip to the length of the same foil strip after corrugation in a direction perpendicular to the corrugating gear roller teeth 62 and 64.

The width of $W_c$ of the corrugated foil strip $F_c$ is less than the width $W_f$ of the flat foil strip $F_f$ in accordance with the equation:

$$W_c=\left(\frac{W_f}{e\tan\beta}\right)\sqrt{\left(\frac{1}{\cos\beta}-\cos\beta\right)^2+e^2\sin^2\beta} \tag{3}$$

Again e is the extension factor for the corrugated foil.

Finally, where $V_c$ is the velocity of the corrugated foil $F_c$ in its direction of delivery from the corrugating machine, and $V_f$ is the velocity of the flat foil strip fed to the machine, $V_f$, $$V_c=V_f\frac{\sin(\alpha)}{\sin(\beta)} \tag{4}$$

It will be apparent to those skilled in the art that various modifications and variations can be made in the skew corrugating method of the present invention and in construction of the described emodiment of the apparatus without departing from the scope or spirit of the invention. For example, the multicomponent construction of the shaft assembly 58 is advantageous from the standpoint of facilitating adjustment of eccentricity of the upper gear roller 60. Where such adjustment is not required, the equivalent of the shaft assembly 58 can be machined in one piece. Also, the required movement of one or both of the gear rollers 50 and 60 between corrugating and released meshing engagement could be accomplished by mechanisms other than the eccentric shaft arrangement represented by the assembly 58. In this respect, reciprocating mechanical or electromechanical devices might be used in place of the eccentric shaft to move the upper gear roller without departure from the broader aspects of the invention.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. Apparatus for continuously forming corrugated metal sheet material in which corrugations are oriented at an oblique angle to side edges of the sheet material, comprising:

a pair of corrugating gear rollers supported for rotation on respective first and second parallel axes, the corrugating gear rollers having meshing linear teeth parallel to the first and second axes, the meshing teeth providing a corrugating nip, at least one of the first and second gear rollers being movable toward and away from the other of said gear rollers to position the teeth in respective conditions of corrugating and released meshing engagement at the corrugating nip;

means for directing a metal sheet material to the corrugating nip along a path at an oblique angle to the axes of the corrugating gear rollers; and means for driving the corrugating gear rollers to corrugate the sheet material and for alternating the teeth between corrugating and released meshing engagement at the corrugating nip.

2. The apparatus of claim 1 wherein said means for alternating the teeth between corrugating and released meshing engagement at the corrugating nip alternates at a frequency at least equal to that at which individual corrugations are formed during corugating meshing engagement of teeth.

3. The apparatus of claim 1 wherein said means for alternating the teeth between corrugating and released meshing engagement at the corrugating nip alternate at a frequency at least twice that at which individual corrugations are formed.

4. The apparatus of claim 1 wherein the at least one of the first and second rollers is moved in an orbital path.

5. The apparatus of claim 4 wherein the orbital path has a diameter that is less than meshing height of the teeth.

6. The apparatus of claim 1 including guide means for directing corrugated sheet material from the corrugating nip substantially in said path.

7. Apparatus for continuously forming a length of corrugated sheet material in which corrugations are oriented at an oblique angle to the length of the sheet material, the apparatus comprising:

a frame;

a first corrugating gear roller supported by the frame for rotation on a fixed axis;

a second corrugating gear roller supported by the frame for rotation on a movable axis, the first and second corrugating gear rollers having linear axial teeth in mesh at a corrugating nip;

means for directing the sheet material to the corrugating nip at an oblique angle to the corrugating nip; and means for driving the corrugating gear rollers to corrugate the sheet material at a rate of individual corrugation formation;

means for moving the movable axis to alternate meshing engagement of the teeth on the corrugating gear rollers between conditions of corrugating and released meshing engagement at the corrugating nip.

8. The apparatus of claim 7 wherein the frequency of alternating meshing engagement is at least equal that of individual corrugation formation.

9. The apparatus of claim 7 wherein the frequency of alternating meshing engagement is at least twice that of individual corrugation formation.

10. A method for continuously forming corrugations in a strip of metal sheet material comprising:

feeding a strip of metal sheet material along a path at an oblique angle to a corrugating nip between a pair of corrugating gear rollers rotatable on parallel axes, the corrugating gear rollers having linear teeth parallel to the axes and in mesh at a corrugating nip, said strip of sheet material having two opposite side edges;

alternating the gear roller teeth between conditions of corrugating and released meshing engagement at the corrugating nip, while continuously feeding the sheet material along the path;

forming corrugations in the sheet with the teeth in corrugating meshing engagement, wherein the corrugations are oriented at an oblique angle to the side edges of the sheet material; and laterally returning the sheet material to the path simultaneously upon movement of the teeth to the condition of released meshing engagement after displacement of the sheet from the path in a direction parallel to the corrugating roller axes during formation of corrugations.

11. The method of claim 10 wherein the alternating of the teeth between corrugating and released meshing engagement is at a frequency at least equal to that of corrugation formation.

12. The method of claim 10 wherein the alternating of the teeth between corrugating and released meshing engagement is at a frequency at least twice that of corrugation formation.

* * * * *